US005678280A

United States Patent [19]

Haab et al.

[11] Patent Number: 5,678,280

[45] Date of Patent: Oct. 21, 1997

[54] APPARATUS FOR GUIDING DISPLACEABLE ELEMENTS

[75] Inventors: Karl Haab, Rotkreuz; Otto Haab, Mettmenstetten, both of Switzerland

[73] Assignee: Hawa AG, Mettmenstetten, Switzerland

[21] Appl. No.: 409,521

[22] Filed: Mar. 24, 1995

[30] Foreign Application Priority Data

Mar. 28, 1994 [CH] Switzerland ..... 00 922/94

[51] Int. Cl.[6] ..... A47H 13/00

[52] U.S. Cl. ..... 16/87.6 R; 16/90; 16/96 R; 16/DIG. 6; 49/410

[58] Field of Search ..... 16/87.6 R, 87, 16/87.4 R, 90, 91, 93 R, 94 R, 95 R, 96 R, 87 B, DIG. 6; 49/410, 411, 409

[56] References Cited

U.S. PATENT DOCUMENTS

| | | | |
|---|---|---|---|
| 23,576 | 11/1859 | Klein . | |
| 1,214,602 | 2/1917 | Smith | 16/DIG. 6 |
| 1,983,959 | 12/1934 | Wuebling . | |
| 2,015,269 | 9/1935 | Henry . | |
| 2,023,873 | 12/1935 | Haven | 16/96 R |
| 2,026,955 | 1/1936 | Weigele | 16/90 |
| 2,027,920 | 1/1936 | Lindquist | 49/411 |
| 2,209,041 | 7/1940 | Sinchuk | 16/DIG. 6 |
| 2,659,939 | 11/1953 | Grieg . | |
| 2,709,107 | 5/1955 | Hoffman | 16/DIG. 6 |
| 2,835,539 | 5/1958 | Conrad | 16/96 R |
| 2,939,167 | 6/1960 | Preston | 16/90 |
| 2,946,098 | 7/1960 | Migneault | 16/90 |
| 4,072,179 | 2/1978 | Naito . | |

FOREIGN PATENT DOCUMENTS

| | | | |
|---|---|---|---|
| 246345 | 1/1961 | Australia | 16/DIG. 6 |
| 675312 | 12/1963 | Canada | 16/DIG. 6 |
| 0312666 | 4/1989 | European Pat. Off. . | |
| 9010154 | 11/1990 | Germany . | |

OTHER PUBLICATIONS

European Search Report.

*Primary Examiner*—Chuck Y. Mah

*Attorney, Agent, or Firm*—Greenblum & Bernstein, P.L.C.

[57] ABSTRACT

Apparatus for guiding displaceable elements. The apparatus of this invention serves for guiding sliding elements, particularly doors, windows, dividing walls, shutters and coverings, that are slidably journalled on an upper side thereof in a first guide and are guided on a lower side thereof with an additional guide which is in turn connected with the floor or a side wall, with the additional guide including at least one elastic element which is adapted for direct force transfer or force transfer via transfer means, so as to press against the underside of the sliding element, so that the underside of the sliding element is retained by the additional guide free from play, thereby avoiding objectionable noises, both at rest and during displacement of the sliding element.

8 Claims, 5 Drawing Sheets

APPARATUS FOR GUIDING DISPLACEABLE ELEMENTS

CROSS REFERENCE TO RELATED APPLICATIONS

This application claims the priority of Swiss Application No. 00 922/94-4, filed Mar. 28, 1994, the disclosure of which is incorporated herein by reference in its entirety.

BACKGROUND OF THE INVENTION

1. Field of the Invention

The present invention pertains to an apparatus for guiding slidable elements, particularly of laterally slidable doors, windows, dividing walls, shutters and coverings, that are slidably journalled on one side in a first guide and are guided on an opposite side with an additional guide connected with one of a floor and a side wall.

2. Discussion of the Background of the Invention and Material Information

Sliding doors which can be actuated via a minimal use of space, are now being utilized to a larger extent in private, industrial and commercial applications. The assembled sliding doors are generally slidably journalled on their upper sides or edges in a guide, such as for example a sliding rail. In order that the sliding door, during opening thereof, does not have a side abutment while being slid into an opening provided therefor, an additional guide element is provided at the lower edge of the door. Known additional guide elements take the shape of a metallic wing which rigidly extends into a guide groove in the bottom edge of the door. The previously described apparatuses which serve for the opening and closing of doors are generally denominated as mounting hardware.

During the construction of such mounting hardware, which serves for guiding sliding doors, care is taken that it allows simple installation, reliable functioning and quiet movement of the doors. European Patent Publication EP 0312777 A1 sets forth a sliding gate carried by coaxial rollers without oscillations.

Even though sliding doors that are provided with known mounting hardware have good sliding characteristics, it is often a noted disadvantage that at rest they can still cause irritating or undesired noises. these noises are caused via the abutment of the door side surface against the additional guide provided at the bottom of the door, during the occurrence of air currents that act against the sliding door. The thereby emanating impact and hitting noises are irritating particularly at low noise levels, for example at night.

It is the task or object of this invention to produce an apparatus for guiding slidable elements which particularly eliminates noises that emanate at the rest position of the sliding elements.

SUMMARY OF THE INVENTION

The task or object of this invention is achieved via an apparatus for guiding sliding elements, such as doors, windows, dividing walls, sliding shutters, and coverings, that are slidably journalled on one side in a first guide and are guided on an opposite side with an additional guide connected with one of a floor and a side wall, wherein the additional guide includes at least one elastic element adapted for one of direct force transfer and for force transfer via transfer means, so as to press the additional guide against an associated side of the sliding element, so that the sliding element is retained without clearance by the additional guide.

In a further embodiment of the apparatus of this invention, the side of the sliding element, facing the additional guide, at least one of an approximately U-shaped and V-shaped guide groove is provided with oppositely located groove sides; and the additional guide is pressed, via the elastic element, one of directly and via transfer means, against at least one of the groove sides.

In another embodiment of the apparatus of this invention, the additional guide is provided with a base plate that aids in the assembly thereof; the base plate is connected with an approximately U-shaped element having wings interconnected with an axle, with the axle journalling a tiltable pivot element, and the pivot element being connected with the approximately U-shaped element in such a manner, that the pivot element is pressed against one of the groove sides.

In a differing embodiment of the apparatus of this invention, the additional guide is provided with a base plate that aids in the assembly thereof and the base plate is connected with an approximately H-shaped element having two pivot elements, with the pivot elements being pressed against the groove sides via a single elastic element.

In yet another embodiment of the apparatus of this invention, the additional guide is provided with a base plate that aids in the assembly thereof and the base plate is provided with a wing, with the wing being approximately vertically arranged relative to the base plate and extending into the guide groove and being surrounded by a leaf spring, the leaf spring being outwardly curved at the sides of the wing against the sides of the grooves and on at least one of the sides of the wing a leaf spring is provided and guided, with the leaf spring being outwardly curved against the groove sides.

In yet a differing embodiment of the apparatus of this invention the additional guide is provided with a base plate that aids in the assembly thereof and the base plate is provided with a wing, with the wing being approximately vertically arranged relative to the base plate and extending into the guide groove and the wing including at least one elastic element, with the elastic element being outwardly curved against the groove sides; and wherein the base plate, the wing and the elastic element are formed of one piece.

In still a further embodiment of the apparatus of this invention, the additional guide is provided with a base plate that aids in the assembly thereof and the base plate is connected with an axle, the axle being approximately vertically arranged relative to the base plate and extending into the guide groove, with a rotatable wing being journalled on the axle, wherein at least one end of the rotatable wing is connected, via an additional axle, with a roller; and wherein an elastic element, connected with the base plate, is provided for the turning of the rotatable wing against the groove side.

In still another embodiment of the apparatus of this invention, the additional guide is provided with a base plate that aids in the assembly thereof and the base plate is connected, via an axle, with a tilt lever, with an end of the tilt lever being provided with a further axle, the further axle serving for journalling a roller, the apparatus further including an elastic element, the elastic element pressing the tilt lever vertically upwardly into the approximately V-shaped guide groove in such a manner that the roller abuts both sides of the guide groove.

In still a differing embodiment of the apparatus of this invention, the additional guide is provided with a base plate that aids in the assembly thereof and the base plate is provided with a holding device, with a guide element being slidably journalled in the V-shaped guide groove such that the guide element is upwardly displaced, via an elastic element, so that the guide element abuts on both sides of the guide groove.

In an additional embodiment of the apparatus of this invention one of the base plate and the elements provided on the base plate, is movable and arrestable in a direction transverse to the direction of movement of the sliding element.

In still an additional embodiment of the apparatus of this invention, the elements provided for the retention of one of the moveable and elastic elements, are utilized for guiding the sliding elements, in the event that one of an elastic element and a part actuated thereby fails.

In yet an additional embodiment of the apparatus of this invention, the elastic elements take the form of one of leaf springs and spiral springs.

In a further differing embodiment of the apparatus of this invention, the U-shaped guide groove is provided with an inlay of one of hard wood and plastic.

In another differing embodiment of the apparatus of this invention, the V-shaped guide groove is provided with an inlay of one of hard wood and plastic.

Via the apparatus of this invention, the noises caused by the slidable elements in their at rest state are eliminated. In addition, the apparatus, which is inexpensive to produce and capable of being easily assembled, achieves an increase in the ease of operation during the displacement of the elements thereof. The wear occurring in the sliding elements is compensated by the apparatus of this invention, whereby the clamping and blocking, that occurs in the known guide elements, is avoided.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
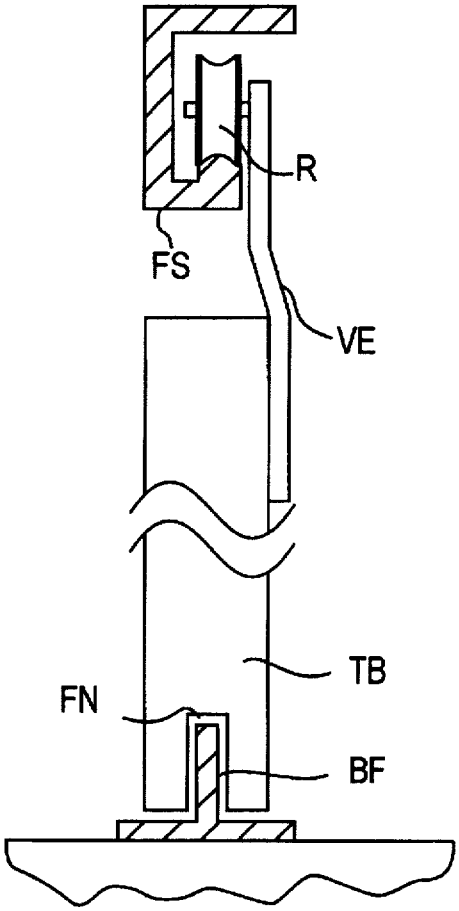
FIG. 1 PRIOR ART
FIG. 1, which is a partially sectional view, shows a prior art slidably journalled element located between an upper and lower guide.

FIG. 1 illustrates a sliding door TB which is displaceably or slidably journalled in an upper guide. The upper guide is comprised of a guide rail FS upon which a roller R is guided, with roller R being connected with sliding door TB via with a connecting element VE and an axle. Sliding door TB includes a guide groove FN on the bottom side or surface thereof, with an additional guide BF, attached to the floor, extending into groove BF. This prior art additional guide BF prohibits that sliding door TB pivots on the lower end thereof and that it can be uncoupled from the upper guide or that it can hit or bump an adjacent wall. As already previously described, the problem with this apparatus remains that, as a result of occurring air movements or currents, sliding door TB bumps against additional guide BF and causes objectional or irritating noises. The clearance or play, present within guide groove FN, which permits these movements, is however necessary in order to prevent binding of additional guide BF within guide groove FN. This clearance is also always chosen to be sufficiently large in order to accommodate occurring changes of the materials (temperature expansions, expansions due to changing moisture content, etc.).

Figure 2A:
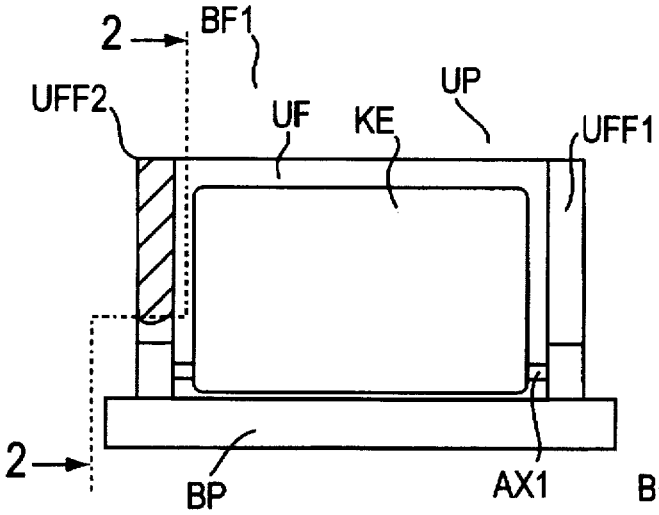
FIG. 2*a*, which is a partially sectioned side elevational view, shows a lower guide (additional guide) that includes a laterally tiltable element, in its installed state.

The previously-described problems are solved in accordance with this invention by the additional guides BF1, . . . ,BF8, to be described in FIGS. 2–9. FIG. 2 illustrates an additional guide BF1, comprised of a base plate BP connectable with the floor or with a side wall and a U-shaped element UP, connected with base plate BP, having two wings or end portions UFF1, UFF2 and an intermediate piece UF for interconnecting wings UFF1, UFF2. Wings UFF1, UFF2 are interconnected, close to base plate BP, via an axle AX1, having a pivot or tilt element KE journalled thereupon in such a manner that it can be tilted or pivoted into or back out of the opening of U-shaped element UP. Preferably, an abutment is provided for limiting the displacement of pivot element KE toward the outside, against which pivot element KE is pressed, via an elastic element FE1, for as long as additional guide element BF is not installed. A suitable elastic element, for example, can take the form of a leaf or spiral spring FE1, which on one side presses against intermediate piece UF and on the other side presses against tilt element KE. FIG. 2*a* illustrates additional guide BF1 in its assembled state. The U-shaped element UP and tiltable element KE project into the U-shaped guide groove FN, provided in the underside or bottom surface of sliding door TB, in such a manner that intermediate piece UF and tilt element KE are in parallel abutment with groove walls NS1 and NS2 of guide groove FN. The force exerted by spring FE1 via tilt element KE presses groove side NS2 to the outside until groove side NS1 abuts on intermediate piece NF. Thus, groove sides NS1 and NS2 are in constant contact with additional guide BF1, so that an opposite abutment or bumping of groove sides NS1 and NS2 onto additional guide BF1 is prohibited at rest as well as during the displacement or sliding of door TB. The occurrence of objectionable noises is thereby avoided.

Preferably, base plate BP and U-shaped element UP are made of a single casting. Additional guide BF1, as per FIGS. 2*a* and 2*b*, can also be enhanced via the use of an H-shaped element HP (instead of U-shaped element UP), in which a tilt elements KE', KE" are could be utilized on each groove side NS1 and NS2, in the manner shown in FIG. 2*c*. Therein, preferably only one elastic element FE' is utilized, which pushes both tilt elements KE', KE" oppositely outwardly and against groove sides NS1 and NS2. FIG. 2*c* illustrates an additional guide BF', comprised of base plate BP and an H-shaped element HP, connected with base plate BP and two wings or end portions HFF1, HFF2 and a centered intermediate piece HF for interconnecting wings HFF1, HFF2. Wings HFF1, HFF2 are also interconnected, close to base plate BP, via axle pairs AX', AX" having pivot or tilt elements KE', KE" journalled thereupon in such a manner that they can be tilted or pivoted into or back out of the opening of H-shaped element HP.

Figure 2B:
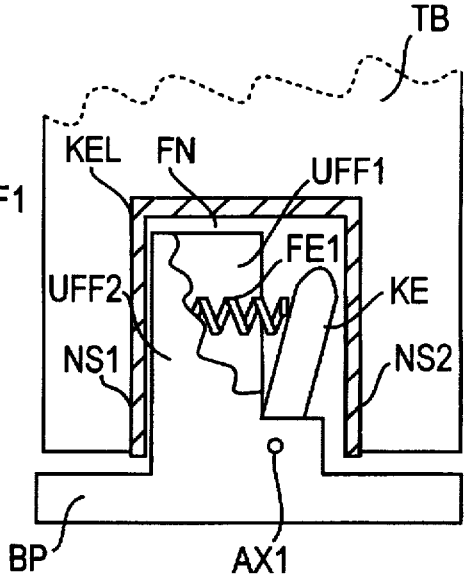
FIG. 2*b*, which is a sectional view, taken along line 2—2 of FIG. 2*a*, shows the addition of a liner KEL.
Figure 2C:
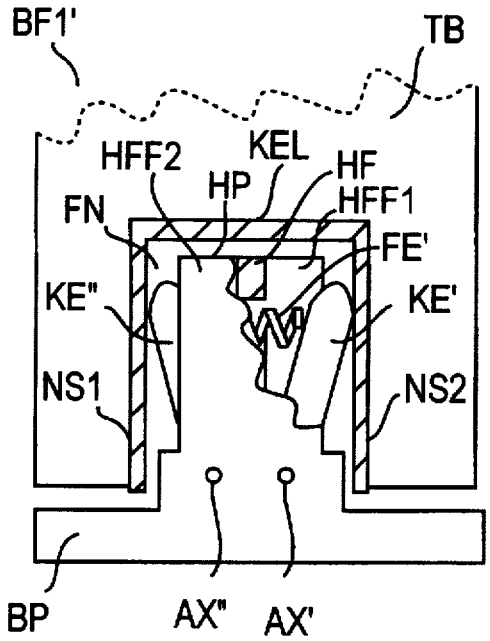
FIG. 2*c*, which is a sectional view, similar to that of FIG. 2*b*, shows the use of an H-shaped support element.

FIG. 2*b* further shows the use of a hardwood or plastic inlay or liner KEL in guide groove FN, with inlay KEL being so correspondingly chosen, relative to the material utilized for additional guide BF1, so that only minimal friction forces occur during the displacement of door TB. The length or extent of wings UFF1, UFF2 of U-shaped element UP is preferably so chosen that additional guide BF1, upon the failure of one of the movable parts FE1,KE,AK1, still performs the function of prior art additional guide BF shown in FIG. 1. This feature is preferably also used in a like manner in additional guides BF1', BF2, . . . ,BF7, to be described hereinafter.

Figure 3A:
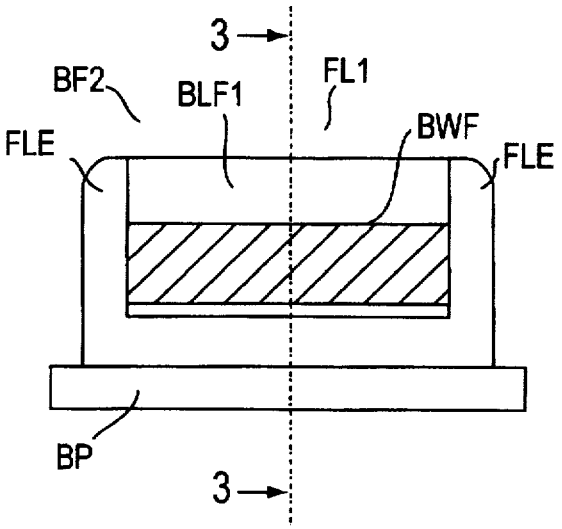
FIG. 3*a*, which is a side elevational view, shows an additional guide with a leaf spring.
Figure 3B:
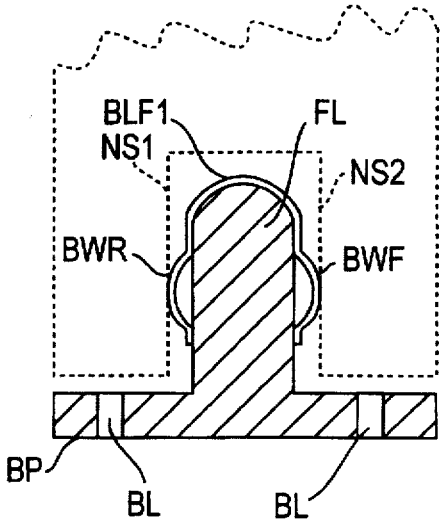
FIG. 3*b*, which is a sectional view, taken along line 3—3 of FIG. 3*a*, shows the additional guide in its installed state.

FIG. 3 illustrates an additional guide BF2 which is comprised of a base plate BP and a connected vertically extending wing FL1, wherein the latter is surrounded by a leaf spring BLF1 which in turn is outwardly bowed, arched or curved at the sides of the wing. FIG. 3*b* illustrates a sectional view of additional guide BF2 in its assembled state. Wing FL1 is located within guide groove FN of sliding door TB. The arches or arcuate portions BWR, BWF of leaf spring BLF1 are in contact with groove sides NS1 and NS2 and press same elastically outwardly, so that sliding door TB is guided without play or clearance, both at rest and during displacement. The ends FLE of wing FL1 have a large cross section, thereby retaining leaf spring BLF1 on both sides in a fixed manner. In addition, wing ends FLE are so dimensioned that, upon the failure of leaf spring BLF1, additional guide unit BF2 still functions in the manner of prior art additional guide BF shown in FIG. 1.

Figure 4A:
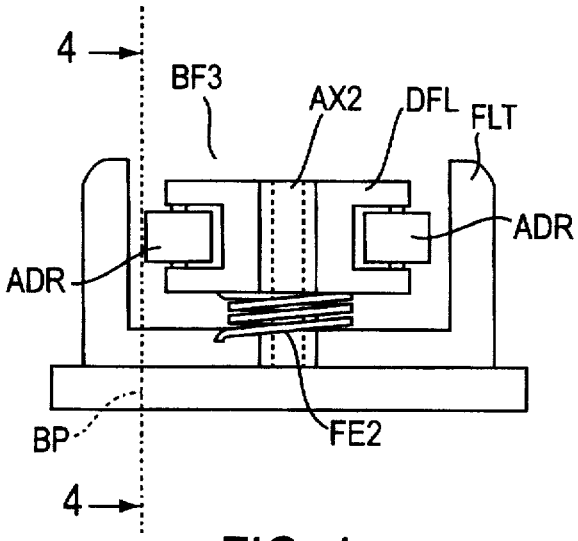
FIG. 4*a*, which is a side elevational view, shows an additional guide with a rotary wing and rollers.
Figure 4B:
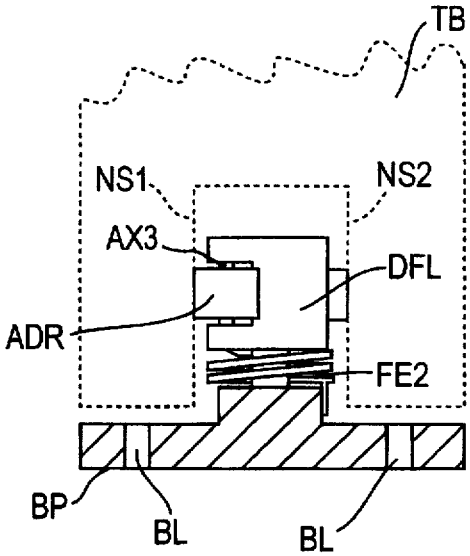
FIG. 4*b*, which is a sectional view, taken along line 4—4 of FIG. 4*a*, shows the additional guide in its installed state.

This minimal function is accomplished in additional guide BF3, illustrated in FIG. 4, via wing portions FLT which are connected with base plate BP, with base plate BP, in addition, being connected, via an axle AX2, with a turnable wing DFL whose ends, in turn, are each connected via additional axes AX3 with a roller ADR. Additional guide BF3 also includes an elastic element, for example a spiral spring FE2, which rotates pivotable wing DF1, relative to base plate BP, around axle AX2. The pivoted movement is preferably bounded via a stop. FIG. 4*b* is a sectional view of additional guide BF3 in the assembled state and shows that rollers ADR are biased against groove walls NS1 and NS2 of groove FN by the force of spring FE2 whereby sliding door TB is guided or held, both at rest and during displacement, without clearance and without noise.

Figure 5A:
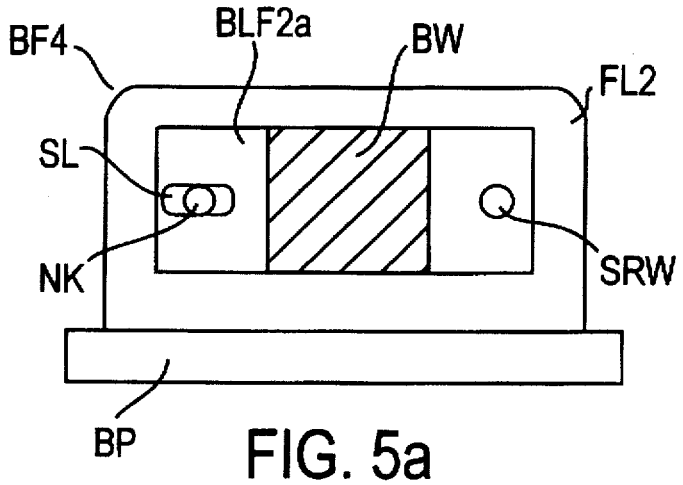
FIG. 5*a*, which is a side elevational view, shows an additional guide where each side thereof is provided with a leaf spring.
Figure 5B:
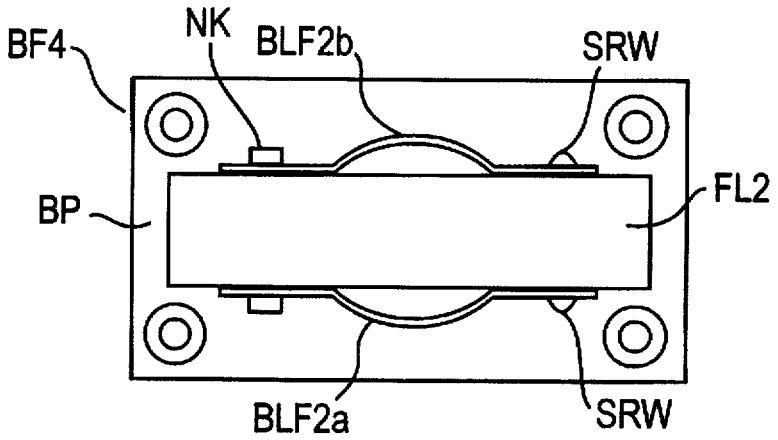
FIG. 5*b* is a top plan view of the additional guide of FIG. 5*a*.

FIG. 5 illustrates a further additional guide BF4 having a wing FL2 with at least one side of wing FL2 being connected with an arcuate leaf spring BLF2*a* and BLF2*b* that are retained on one side by a retainer element SRW. The other side of leaf spring BLF2*a* included a slot SL, with a cam NK, connected with wing FL2, extending thereinto. During the pressing of leaf spring BLF2, it is then guided by cam NK. The cross hatched arcuate portion BW of leaf spring BLF2*a* presses additional guide BF4, after the assembly thereof, against groove walls NS1 and NS2 of the guide groove, whereby sliding door TB is again held or guided in a noise-free manner. If, as shown in FIG. 5*b*, leaf springs BLF2*a*, BLF2*b* are used on both sides of wing FL2, the arcuate portions thereof are preferably directly oppositely located. This prevents a turning movement, via sliding door TB, relative to installed additional guide BF4.

Figure 6:
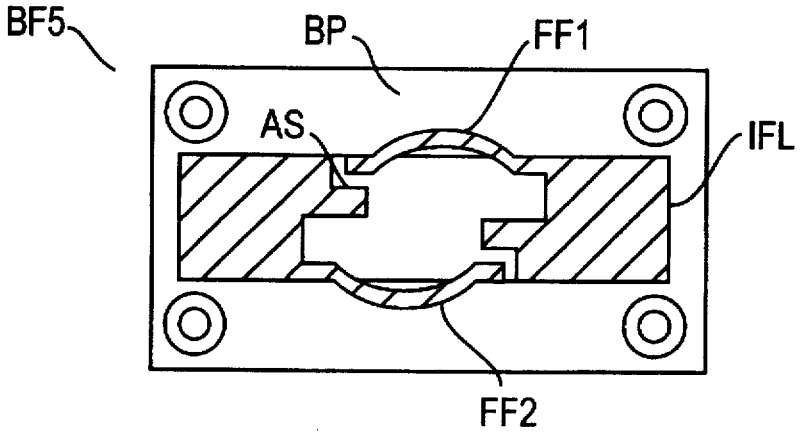
FIG. 6, which is a top plan view, shows an additional guide with two continuously connected guide elements.

FIG. 6 illustrates a further additional guide BF5 which includes a base plate BP, a wing IFL and two elastic or spring elements FF1, FF2, which are designed for pressing against groove sides NS1 and NS2 of guide groove FN. Spring elements FF1, FF2 can preferably be pressed against wing IFL only until they contact or abut a stop AS. The construction of additional guide BF5 is particularly advantageous in that base plate BP, wing IFL and spring elements FF1, FF2 are produced inexpensively and in a single piece. Thus, the procurement and assembly of leaf springs BLF, shown in FIG. 5, is avoided.

Figure 7A:
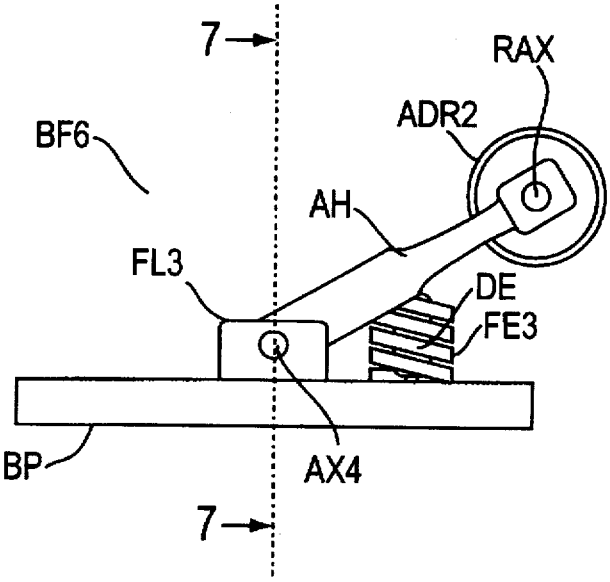
FIG. 7*a*, which is a side elevational view, shows an additional guide with a vertically displaceable lever and a roller.
Figure 7B:
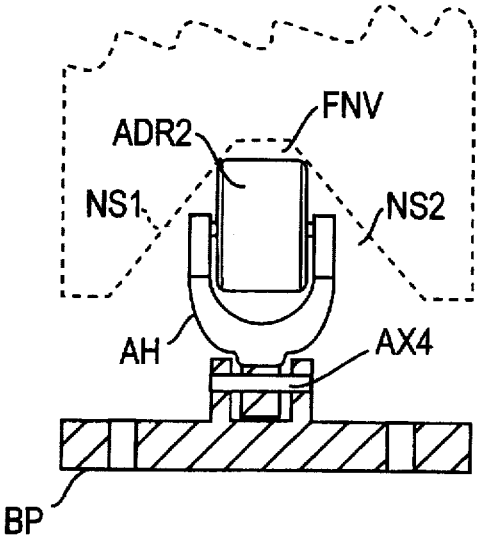
FIG. 7*b*, which is a sectional view, taken along line 7—7 of FIG. 7*a*, shows the additional guide in its assembled state.

FIG. 7 illustrates an additional guide BF6 having a roller ADR2 which is pressed into an approximately V-shaped lower guide groove FNV of sliding door TB. Roller ADR2 is connected with base plate BP by means of a lever AH via a linkage (axle AX4 and wing FL3). Lever AH is vertically upwardly pressed or biased via an elastic element, for example a spiral spring FE3, so that roller ADR2 contacts both sides NS1, NS2 of guide groove FNV. Thereby, sliding door TB is again held or guided so that the door does not abut or contact additional guide BF6 and causes noise.

Figure 8A:
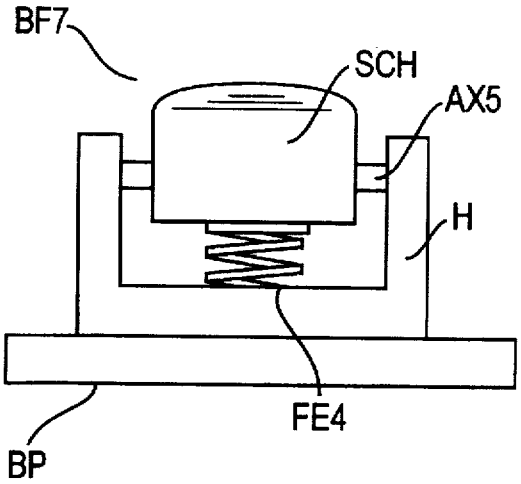
FIG. 8*a*, which is a side elevational view, shows an additional guide with a vertically displaceable element.
Figure 8B:
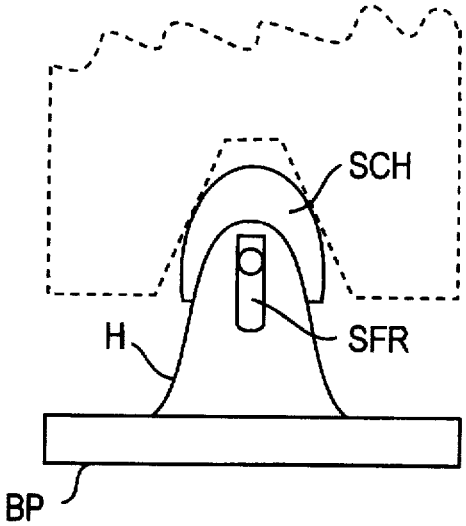
FIG. 8*b* which is an end view of the FIG. 8 guide, shows the guide in its installed state.

FIG. 8 illustrates a further additional guide BF7 having a guide element SCH that is vertically displaceable into an approximately V-shaped lower guide groove FNV of sliding door TB. Guide element SCH is retained by an axle AX5 whose ends, in turn, are guided in slits SFR that are provided in a U-shaped retainer H that is connected with base plate BP. An elastic element, for example a spiral spring FE4, is provided for the vertical displacement of guide element SCH. Vibrations of sliding door TB are thus transferred, as set forth relative to previously-described additional guides BF1, . . . ,BF6, to elastic element FE4 and absorbed by same. Preferably, elastic elements are selected that have high absorption characteristics. In addition to the springs, for example, known hydraulic dampers can be utilized. For this purpose, in FIG. 7, a hydraulic damper DE is arranged in parallel with spiral spring FE3.

Figure 9:
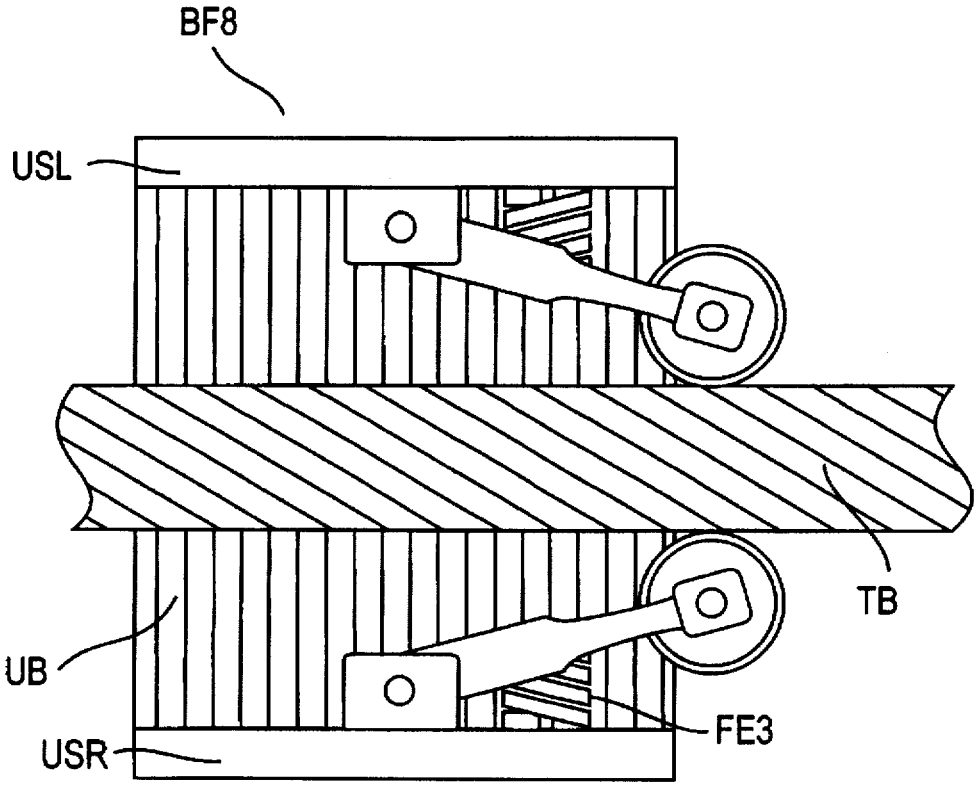
FIG. 9 shows a U-shaped additional guide in which the slidable element is guidable.

If sufficient space is available, and a guide groove is undesirable in the bottom surface of sliding door TB, additional guides BF1, . . . ,BF7 can also be arranged on the outside or vertical surfaces of sliding door TB. Via the use of elastic elements, which act against sliding door TB, preferably from both sides, vibrations can be transferred to additional guide BF and prohibits an abutment or impact thereagainst. FIG. 9 illustrates a U-shaped additional guide BF8, via which a sliding door TB is guided and held. Two additional guides BF7, described with reference to FIG. 7, form the wing portions, USL, USR of additional guide BF8, with the former being connected by an intermediate piece UB. Additional guide BF8 however requires more space, is more expensive to produce and leaves marks on the lower portion of sliding door TB.

Even though the description of the inventive embodiments of this invention pertains mostly to a sliding door TB, the apparatus of this invention can be utilized for any desired slidable or displaceable elements such as doors, windows, dividing walls and coverings, etc. Additional guides BF1, . . . ,BF8 can be installed either on the floor or on a wall. Preferably, the elements arranged on base plate BP (namely U-shaped element UP in FIG. 2; wings FL1, FL2 in FIGS. 3 and 5; pivoting wing DFL in FIG. 4; tilt lever AH in FIG. 7; and retainer H in FIG. 8) are movably and arrestably arranged perpendicular to the direction of movement of sliding door TB. In that manner, additional guides Bf1, . . . ,BF8 correspond to the extent of sliding door TB, that is guide groove FN, FNV, and are easier to adjust.

It should be evident that the apparatus of this invention can also be advantageously utilized in case a sliding element (TB) is guided on the underside via a guide rail and the upper side is guided by an additional guide BF1, . . . ,BF8.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. An apparatus for guiding sliding elements, such as doors, windows, dividing walls, sliding shutters, and coverings, that are slidably journalled on one side in a first guide and are guided on an opposite side with an additional guide connected with one of a floor and a side wall, the additional guide comprising:

at least one elastic element adapted for one of a direct force transfer means and an indirect force transfer means, said at least one elastic element for pressing against an associated side of the sliding element and for retaining the sliding element by contact, a base plate for mounting the additional guide;

the base plate coupled to a wing that is approximately vertically arranged relative to the base plate for extending into a guide groove of the sliding element, the wing including the at least one elastic element, with the elastic element being outwardly curved for contacting the associated side of the sliding element; and the base plate, the wing and the at least one elastic element formed of one piece.

2. The apparatus of claim 1, wherein one of the base plate and the at least one elastic element is movable in a direction transverse to a sliding direction of the sliding element.

3. The apparatus of claim 1, the wing being locatable within the at least one guide groove for guiding the sliding element when the at least one elastic element fails.

4. The apparatus of claim 3, the at least one elastic element comprising one of a leaf spring and a spiral spring.

5. An apparatus for guiding sliding elements, such as doors, windows, dividing walls, sliding shutters, and coverings, that are slidably journalled on one side in a first guide and are guided on an opposite side with an additional guide connected with one of a floor and a side wall, the additional guide comprising:

at least one elastic element adapted for one of a direct force transfer means and an indirect force transfer means, said at least one elastic element for pressing against a side of at least one of an associated U-shaped or V-shaped guide groove of the sliding element and for retaining the sliding element by contact, a base plate for mounting the additional guide;

the base plate coupled to a wing that is approximately vertically arranged relative to the base plate for extending into the at least one guide groove, the wing including the at least one elastic element, with the elastic element being outwardly curved for contacting the side; and the base plate, the wing and the at least one elastic element formed of one piece.

6. The apparatus of claim 5, wherein one of the base plate and the at least one elastic element is movable in a direction transverse to a sliding direction of the sliding element.

7. The apparatus of claim 5, the wing being locatable within the at least one guide groove for guiding the sliding element when the at least one elastic element fails.

8. The apparatus of claim 7, the at least one elastic element comprising one of a leaf spring and a spiral spring.

* * * * *